PFR09 XR 3,953,647

United States Patent [19]

Brennan et al.

[11] 3,953,647

[45] Apr. 27, 1976

[54] GRAPHITE FIBER REINFORCED METAL MATRIX COMPOSITE

[75] Inventors: John J. Brennan, Portland; Norman S. Bornstein, West Hartford, both of Conn.

[73] Assignee: United Technologies Corporation, Hartford, Conn.

[22] Filed: Oct. 5, 1973

[21] Appl. No.: 404,084

[52] U.S. Cl. ..... 428/378; 29/195; 29/197; 428/295; 427/214

[51] Int. Cl. ..... B32b 5/16

[58] Field of Search ..... 161/170, 176; 117/71 R, 117/71 M, DIG. 11, 128, 131 R; 29/195 C, 195 R, 197

[56] References Cited

UNITED STATES PATENTS

| | | | |
|---|---|---|---|
| 3,427,185 | 2/1969 | Cheatham et al. | 117/128 |
| 3,544,348 | 12/1970 | Boone et al. | 117/107.2 P |
| 3,595,712 | 7/1971 | Boone et al. | 117/107.2 P |
| 3,647,517 | 3/1972 | Milidantri et al. | 117/107.2 P |
| 3,736,159 | 5/1973 | Gibson et al. | 161/170 |
| 3,766,000 | 10/1973 | Gibson et al. | 161/170 |
| 3,770,488 | 11/1973 | Pepper et al. | 117/71 R |
| 3,796,587 | 3/1974 | Sara | 117/71 R |

*Primary Examiner*—George F. Lesmes
*Assistant Examiner*—Patricia C. Ives
*Attorney, Agent, or Firm*—John D. Del Ponti

[57] ABSTRACT

A novel filament reinforced composite comprising a plurality of fibers selected from the group consisting of graphite fibers, amorphous carbon fibers and pyrolytic graphite fibers bonded together in an aluminide matrix, selected from the group consisting of nickel aluminide, cobalt aluminide and solutions and mixtures thereof, said composite having relatively high strengths at elevated temperatures.

5 Claims, 1 Drawing Figure

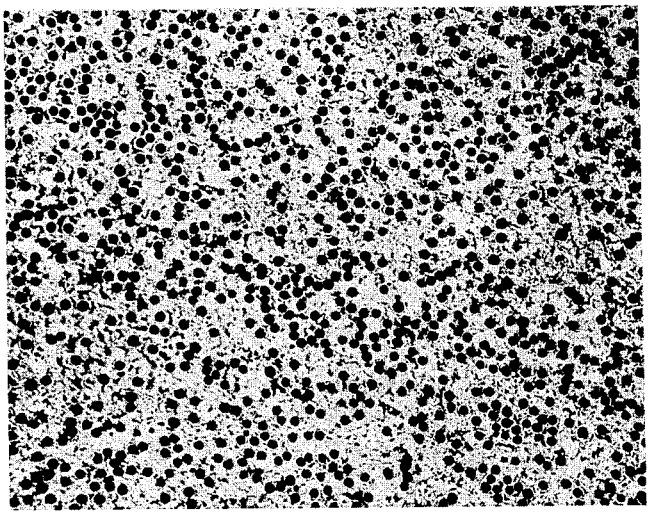

GRAPHITE FIBER REINFORCED METAL MATRIX COMPOSITE

BACKGROUND OF THE INVENTION

This invention relates to reinforced metallic composites and a method of making the same. More particularly, the invention relates to a graphite fiber reinforced aluminide intermetallic composite having high temperature strength.

The aerospace industry has recognized the advantages of composite materials of construction, particularly those which exhibit superior physical properties such as low density combined with high temperature strength and oxidation resistance. One of the most promising materials for use in composite construction is graphite fiber such as that high strength, high modulus carbon fiber and yarn composed essentially of amorphous carbon but more preferably of graphite or pyrolytic graphite and generally referred to as graphite fiber and yarn. Although such graphite fiber has heretofore been used in the formation of useful composites, the need for refractory composites having high temperature strength and oxidation resistance has continued.

SUMMARY OF THE INVENTION

The present invention contemplates a refractory composite having high temperature strength/density ratios which equal or exceed those of titanium. More particularly, it relates to a refractory fiber reinforced composite article comprising a plurality of graphite fibers selected from the group consisting of graphite fibers, amorphous carbon fibers and pyrolytic graphite fibers bonded together in an aluminide matrix selected from the group consisting of nickel aluminide, cobalt aluminide and solutions and mixtures thereof. In a preferred embodiment, the graphite fibers are unidirectionally oriented and the intermetallic matrix consists of nickel aluminide consisting essentially of $Ni_3Al$ and/or NiAl, preferably 80–100% by weight $Ni_3Al$, balance, if any, NiAl.

The present invention also resides in a process for making such a product. More specifically, it covers a method for making a refractory fiber reinforced composite article comprising depositing a continuous coating of nickel, cobalt or mixtures thereof on the surface of a fiber selected from the group consisting of graphite, amorphous carbon and pyrolytic graphite, mixing together an aluminum containing metal powder and sufficient inert liquid to form a slurry, the metal powder preferably being of a particle size not larger than about 4 microns and being selected from the group consisting of Al, NiAl and mixtures thereof, providing a plurality of graphite fibers in oriented, substantially parallel relationship, flowing the slurry into the spaces between the fibers, the size of the spaces and the amount of metal in the slurry being sufficient to give a ratio of fibers to metal matrix ranging from, by volume, about 10% of fibers and about 90% of metal matrix to about 60% of fibers and about 40% of metal matrix, preferably 35–50% fiber and 50–65% metal matrix, removing the liquid from the slurry and reacting the nickel coating with the metal powder by hot pressing in a nonoxidizing atmosphere. In one process, the nickel coating is reacted with the refractory metal by heating for about one hour at 900°–1400°C and 2000–5000 psi in a nonoxidizing atmosphere, preferably for approximately one hour at 1000°–1300°C and 2000–5000 psi in vacuum.

BRIEF DESCRIPTION OF THE DRAWING

An understanding of the invention will become more apparent to those skilled in the art by reference to the following detailed description when viewed in light of the accompanying drawing which is a photomicrograph showing in cross section a typical graphite fiber-NiAl, $Ni_3Al$ composite enlarged 200 times.

DETAILED DESCRIPTION OF THE PREFERRED EMBODIMENTS

It has been found that novel fiber reinforced composites may be prepared by depositing a continuous coating of a metal selected from the group consisting of nickel, cobalt and mixtures thereof on the surface of a graphite fiber, mixing together a refractory-forming metal powder selected from the group consisting of aluminum, NiAl and mixtures thereof, with an inert liquid to form a slurry, orienting a plurality of the coated fibers into substantially parallel relationship, flowing the slurry in the spaces between the fibers, the size of the spaces and the amount of said powder in said slurry being sufficient to give a ratio, after hot pressing, of fibers to refractory metal matrix ranging from, by volume, about 10% of fibers and about 90% of refractory intermetallic matrix to about 60% of fibers and about 40% of refractory intermetallic matrix, removing the inert liquid from the slurry and reacting said continuous coating with said metal powder to form an intermetallic matrix by hot pressing in a nonoxidizing atmosphere. As indicated hereinbefore, graphite fiber is intended to include graphite, pyrolytic graphite and amorphous carbon fibers and yarns.

The following examples illustrate in detail the preferred practice of the present invention.

EXAMPLE I (COOY)

Morganite I graphite fiber tows comprising radical, 10,000 7 $\mu$ fibers per tow were cut into approximately ten inch lengths and electroplated, using a conventional Watts bath, with a thin (approximately 2 $\mu$) layer of nickel. As will be appreciated, the thickness of the nickel plate, its uniformity and adherency is directly related to the current density, bath temperature and degree of agitation. The preferred plating conditions were approximately 135°F and 1–5 amps/ft$^2$ with constant agitation. After plating, the tows were immersed in a continuously stirred slurry of NiAl powder (−400 mesh) and diacetone alcohol (2 gms powder/50 ml alcohol) for approximately one minute and then stripped, by finger wiping pressure, of excess NiAl slurry. The tows were then cut into 2 ¾ inch lengths and twenty such lengths were laid up in a graphite die having an opening of ⅝ × 2 ¾ inch and allowed to dry. Hot pressing was effected under vacuum (approximately $10^{-4}$ mm Hg) at 1250°C, 5000 psi for 1 hour. The resulting composite, shown in the drawing, consisted of approximately 20 volume percent graphite fibers incorporated in an intermetallic nickel aluminide matrix consisting of phases of about 80% NiAl and about 20% $Ni_3Al$. The room temperature UTS was 33,200 psi.

EXAMPLE II

Example I was repeated except as follows. After nickel plating, the tows were run through a slurry of submicron Al powder (Reynold's 40XD Al flake) suspended in xylene plus 5 weight percent dissolved polystyrene as a binder (1 gm of Al powder to 50 ml of solution). Hot pressing was done under a vacuum of approximately $10^{-4}$ mm Hg at 1200°C and 3500 psi for 1 hour. The resulting composite consisted of approximately 40%, by volume, graphite fibers incorporated in an intermetallic nickel aluminide matrix consisting of phases of about 90% $Ni_3Al$ and about 10% NiAl. This composite exhibited a room temperature UTS of 82,300 psi and a Young's modulus of $33.4 \times 10^6$ psi.

EXAMPLE polymeric ml consisting

Example II was repeated except as follows. Toluene was substituted for xylene and SO*concentration of Al was increased to* 2 gm Al powder per 50 of solution. The resulting composite consisted of approximately 40% by volume graphite fibers incorporated in an intermetallic nickel aluminide matrix consistng of phases of about 90% $Ni_3Al$ and about 10% NiAl. This composite exhibited a room temperature UTS of 69,000 psi and a UTS at 1300°F of 36,000 psi.

Example IV

Example II was repeated except as follows. Toluene was substituted for xylene and the concentration of Al was increased to 2 gm Al powder per 50 ml of solution. Hot pressing was done in argon at 1100°C and 3500 psi for 1 hour. The resulting composite consisted of approximately 40 volume percent graphite fibers embedded in an intermetallic nickel aluminide matrix consisting of phases of about 90% $Ni_3Al$ and about 10% NiAl. This composite tested out with a UTS at 1800°F of 25,000 psi.

It will be appreciated, particularly when reference is had to the following table, that the sample composites exhibit a marked increase in mechanical properties when compared to unreinforced $Ni_3Al$ or NiAl. aromatic, 2–1–

Table I

| Material | Density (gm/cc) | RT UTS | 1300°F UTS | 1800°F UTS |
|---|---|---|---|---|
| NiAl* | 5.9 | 15,000 | — | 9,600 |
| $Ni_3Al$* | 7.48 | 30,000 | — | 8,000 |
| Exs. 2–4 | 3.9–4.7 | 82,300 | 36,000 | 25,000 |

*From Grala, E. M., "Investigations of NiAl and $Ni_3Al$", Intermetallic Compounds, Chapter 17, pp. 358–404, 1960.

It will also be appreciated that the inventive composites also compare favorably with certain other materials, notably commercially available titanium alloys, such as Ti-6% Al-4% V. The average strength of such titanium alloys at room temperature is typically of the order of 150–180,000 psi but drops dramatically (80–100,000 psi at 800°F and 10–20,000 psi at 1000°F) at elevated temperatures. It is evident that since the density of the composite of the present invention is equal to that of titanium (4.54 gm/cc), the graphite reinforced nickel aluminide composite is superior for elevated temperature use.

In the above Examples, parts is to aromatic noted that any alcohol or aromatic solvent other than xylene or toluene may be used as the solvent for the Al and NiAl slurrys and any resin that decomposes on heating other than polystyrene, such as poly B-D or any acrylonitrile butadiene copolymer may be used as the binder. In addition, it will be recognized that alloying additions, such as cobalt, can be introduced into the composite as for example by utilizing a Ni-Co plating bath rather than pure Ni. Lastly, although in all of the Examples the graphite fibers were electroplated, the process is not limited to electrodeposition and the many electroless nickel deposition baths and thermal decomposition processes such as carbonyl and sulfate may also be used.

What has been set forth above is intended primarily as exemplary to enable those skilled in the art in the practice of the invention and it should therefore be understood that, within the scope of bars appended claims, the invention may be practiced in other ways than as specifically described. specimens.

What is claimed is:

1. A refractory fiber reinforced composite article comprising a plurality of fibers selected from the group consisting of graphite fibers, amorphous carbon fibers and pyrolytic graphite fibers bonded together in an aluminide intermetallic matrix selected from the group consisting of nickel aluminide, cobalt aluminide and solutions and mixtures thereof, said fibers comprising approximately, by volume, 10-60% of said composite article.

2. The article of claim 1 wherein said fibers are unidirectionally oriented.

3. The article of claim 2 wherein said intermetallic matrix is nickel aluminide. classified,

4. The article of claim 3 wherein said intermetallic matrix consists essentially of a nickel aluminide selected from the group consisting of $Ni_3Al$, NiAl and both $Ni_3Al$ and NiAl.

5. The article of claim 3 wherein said intermetallic matrix consists essentially of, by weight, 80–100% $Ni_3Al$, balance, if any, NiAl.

* * * * *

UNITED STATES PATENT OFFICE

CERTIFICATE OF CORRECTION

PATENT NO. : 3,953,647

DATED : April 27, 1976

INVENTOR(S) : John J. Brennan and Norman S. Bornstein

It is certified that error appears in the above-identified patent and that said Letters Patent are hereby corrected as shown below:

| | |
|---|---|
| Column 1, line 53 | "4" should read -- 40 -- |
| Column 2, line 39 | delete (COOY) |
| Column 2, line 40 | delete "radical" |
| Column 3, line 13 | delete "polymeric ml consisting" and insert -- III -- |
| Column 3, lines 15 and 16 | delete "SO concentration of Al was increased to" and insert -- the concentration of Al was increased to -- |
| Column 3, line 16 | after "50" insert -- ml -- |
| Column 3, lines 39 and 40 | delete "aromatic, 2-1-" |
| Column 4, line 10 | "parts" should read -- it -- |
| Column 4, line 10 | "aromatic" should read -- be -- |
| Column 4, line 28 | "bars" should read -- the -- |
| Claim 3, Column 4, line 44 | delete "classified," |

Signed and Sealed this

Twentieth Day of July 1976

[SEAL]

*Attest:*

RUTH C. MASON
*Attesting Officer*

C. MARSHALL DANN
*Commissioner of Patents and Trademarks*